US010729181B2

(12) United States Patent
Zinovik et al.

(10) Patent No.: US 10,729,181 B2
(45) Date of Patent: Aug. 4, 2020

(54) HEATER ASSEMBLY FOR AN AEROSOL-GENERATING SYSTEM

(71) Applicant: Philip Morris Products S.A., Neuchatel (CH)

(72) Inventors: Ihar Nikolaevich Zinovik, Peseux (CH); Jerome Courbat, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 80 days.

(21) Appl. No.: 15/737,938

(22) PCT Filed: Jun. 15, 2016

(86) PCT No.: PCT/EP2016/063807

§ 371 (c)(1),
(2) Date: Dec. 19, 2017

(87) PCT Pub. No.: WO2017/005471

PCT Pub. Date: Jan. 12, 2017

(65) Prior Publication Data

US 2018/0168225 A1 Jun. 21, 2018

(30) Foreign Application Priority Data

Jul. 9, 2015 (EP) ..... 15176164

(51) Int. Cl.
*A24F 13/00* (2006.01)
*A24F 47/00* (2020.01)

(52) U.S. Cl.
CPC ..... *A24F 47/008* (2013.01)

(58) Field of Classification Search
CPC ..... A24F 47/00
(Continued)

(56) References Cited

U.S. PATENT DOCUMENTS 5,573,692 A 11/1996 Das et al.
2008/0092912 A1* 4/2008 Robinson ..... A24F 47/008 131/200

(Continued)

FOREIGN PATENT DOCUMENTS

CN 101557728 A 10/2009
CN 102014677 A 4/2011

(Continued)

OTHER PUBLICATIONS

"Gaining Strength for the Next Level", Oerlikon Corporate, https://www.oerlikon.com/en/company/company-overview/surface-sol . . . , 2015, 2 pages.

(Continued)

*Primary Examiner* — Phuong K Dinh
(74) *Attorney, Agent, or Firm* — Oblon, McClelland, Maier & Neustadt, L.L.P.

(57) ABSTRACT

There is provided a heater assembly for an aerosol-generating system including a liquid storage portion configured to hold a liquid aerosol-forming substrate, the heater assembly including an electric heater having at least one heating element configured to heat the liquid aerosol-forming substrate to form an aerosol, and a capillary body configured to convey the liquid aerosol-forming substrate from the liquid storage portion of the aerosol-generating system to the at least one heating element, the at least one heating element being formed from an electrically conductive material deposited directly onto a porous outer surface of the capillary body. A cartridge for an aerosol-generating system and a method for manufacturing such a cartridge are also provided.

16 Claims, 6 Drawing Sheets

(58) Field of Classification Search
USPC ..... 131/328–329
See application file for complete search history.

(56) References Cited

U.S. PATENT DOCUMENTS

| | | | | |
|---|---|---|---|---|
| 2011/0277756 | A1 | 11/2011 | Terry et al. | |
| 2014/0060554 | A1 | 3/2014 | Collett et al. | |
| 2014/0246020 | A1 | 9/2014 | Minskoff et al. | |
| 2015/0027459 | A1 | 1/2015 | Collett et al. | |
| 2015/0164143 | A1 | 6/2015 | Maas | |
| 2016/0135505 | A1 | 5/2016 | Li et al. | |
| 2017/0251729 | A1 | 9/2017 | Li et al. | |
| 2017/0325505 | A1* | 11/2017 | Force | A24F 47/008 |
| 2019/0174828 | A1 | 6/2019 | Holtz et al. | |
| 2020/0107582 | A1 | 4/2020 | Mizuguchi et al. | |
| 2020/0129710 | A1 | 4/2020 | Zhang et al. | |
| 2020/0146348 | A1 | 5/2020 | Hon | |

FOREIGN PATENT DOCUMENTS

| | | | |
|---|---|---|---|
| CN | 102655773 | A | 9/2012 |
| CN | 104475262 | A | 4/2015 |
| CN | 204 317 492 | U | 5/2015 |
| DE | 198 54 005 | A1 | 5/2000 |
| EP | 2 316 286 | A1 | 5/2011 |
| EP | 2 807 935 | A1 | 12/2014 |
| JP | 2015-504652 | | 2/2015 |
| WO | WO 2015/117704 | A1 | 8/2015 |
| WO | WO 2016/174179 | A1 | 11/2016 |

OTHER PUBLICATIONS

"410 stainless steel powder", READE Advanced Materials, https://web.archive.org/web/20150318123606/http://www.reade.com/i . . . , 2018, 1 page.

International Search Report and Written Opinion dated Sep. 23, 2016 in PCT/EP2016/063807, filed Jun. 15, 2016.

Chinese Office Action and Search Report with English translation dated Feb. 6, 2020 in counterpart Chinese Patent Application No. 201680035452.0, (18 pages).

Office Action dated Jun. 2, 2020 in U.S. Appl. No. 16/868,706 (11 pages).

* cited by examiner

HEATER ASSEMBLY FOR AN AEROSOL-GENERATING SYSTEM

TECHNICAL FIELD

The present invention relates to aerosol-generating systems and to heater assemblies for aerosol-generating systems, the heater assemblies comprising an electric heater that is suitable for vaporising an aerosol-forming substrate. In particular, the invention relates to handheld aerosol-generating systems, such as electrically operated smoking systems. Aspects of the invention relate to heater assemblies for an aerosol-generating system, cartridges for an aerosol-generating system and to methods for manufacturing those cartridges.

DESCRIPTION OF THE RELATED ART

One type of aerosol-generating system is an electrically operated smoking system. Handheld electrically operated smoking systems consisting of a device portion comprising a battery and control electronics, and a cartridge portion comprising a supply of aerosol-forming substrate, and an electrically operated vapouriser, are known. A cartridge comprising both a supply of aerosol-forming substrate and a vapouriser is sometimes referred to as a "cartomiser". The vapouriser is typically a heater assembly. In some known examples, the aerosol-forming substrate is a liquid aerosol-forming substrate and the vapouriser comprises a coil of heater wire wound around an elongate wick soaked in liquid aerosol-forming substrate. The cartridge portion typically comprises not only the supply of aerosol-forming substrate and an electrically operated heater assembly, but also a mouthpiece, which the user sucks on in use to draw aerosol into their mouth.

Thus, electrically operated smoking systems that vaporize an aerosol-forming liquid by heating to form an aerosol typically comprise a coil of wire that is wrapped around a capillary material that holds the liquid. Electric current passing through the wire causes resistive heating of the wire which vaporises the liquid in the capillary material. The capillary material is typically held within an airflow path so that air is drawn past the wick and entrains the vapour. The vapour subsequently cools to form an aerosol.

This type of system can be effective at producing aerosol but it can also be challenging to manufacture in a low cost and repeatable way. Furthermore, the wick and coil assembly, together with associated electrical connections, can be fragile and difficult to handle.

It would be desirable to provide a heater assembly for an aerosol-generating system, such as a handheld electrically operated smoking system, that has improved aerosol characteristics. It would be further desirable to provide more robust heater assembly for an aerosol-generating system and to provide a cartridge for an aerosol-generating system that has improved aerosol characteristics.

SUMMARY

According to a first aspect of the present invention, there is provided a heater assembly for use in an aerosol-generating system having a liquid storage portion for holding a liquid aerosol-forming substrate, the heater assembly comprising; an electric heater having at least one heating element for heating the liquid aerosol-forming substrate to form an aerosol; and a capillary body for conveying the liquid aerosol-forming substrate from the liquid storage portion of the aerosol-generating system to the at least one heating element, wherein the at least one heating element is formed from an electrically conductive material deposited directly onto a porous outer surface of the capillary body.

BRIEF DESCRIPTION OF THE DRAWINGS

Embodiments of the invention will now be described, by way of example only, with reference to the accompanying drawings, in which.

DETAILED DESCRIPTION

Figure 1A:
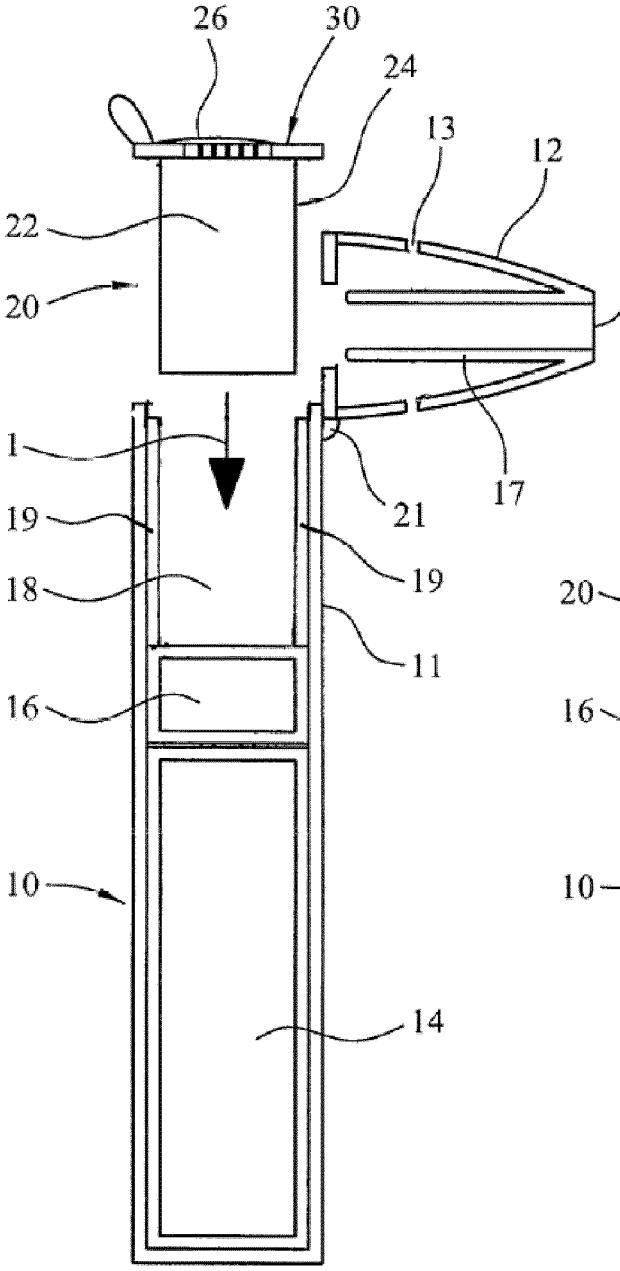
FIGS. 1A to 1D are schematic illustrations of a system, incorporating a cartridge, in accordance with an embodiment of the invention.

Advantageously, by depositing an electrically conductive material directly onto the porous outer surface of the capillary body to form the at least one heating element, contact between the at least one heating element and the capillary body may be improved. For example by compensating for surface roughness or unevenness on the outer surface of the capillary body. This may enable a reduction in the number or severity of "hot spots" on the outer surface of the capillary body which may otherwise occur if the heating element is not in contact with the capillary body across its length and may, therefore, result in improved aerosol characteristics. Improved contact between the at least one heating element and the capillary body may also allow improved delivery of the liquid aerosol-forming substrate to the heating element.

Additionally, by forming the heating element by depositing an electrically conducting material directly onto the porous outer surface of the capillary body, the heating element is adhered to the capillary body. This reduces the risk of a loss of contact between the heating element and the capillary body caused by deformation of the heating element, for example during assembly or due to thermal stresses induced during use. It also allows heater geometries or layouts to be used which might not otherwise be possible. For example, heating element geometries or layouts which are more complex or which use thinner filaments than would be possible using a pre-formed electric heater.

As used herein, the term "capillary body" refers to a component of the heater assembly that is able to convey the liquid aerosol-forming substrate to the electric heater by capillary action.

As used herein, the term "electrically conductive material" denotes a material having a resistivity of $1\times10^{-2}$ Ωm, or less.

As used herein, the term "deposited" means applied as a coating on the outer surface of the capillary body, for example in the form of a liquid, plasma or vapour which subsequently condenses or aggregates to form the heating element, rather than simply being laid on the capillary body as a solid, pre-formed component.

As used herein, the term "deposited directly" means that the electrically conductive material is deposited onto the porous outer surface of the capillary body such that the at least one heating element is in direct contact with the porous outer surface.

As used herein, the term "porous" means formed from a material that is permeable to the liquid aerosol-forming substrate and allows the liquid aerosol-forming substrate to migrate through it.

In certain preferred embodiments, the electrically conductive material of the at least one heating element is at least partially diffused into the porous outer surface of the capillary body.

As used herein, the term "diffused into the porous outer surface" means that the electrically conductive material is embedded in, or intermingled with, the material of the porous outer surface at the interface between the electrically conductive material and the capillary body, for example by extending into the pores of the porous outer surface.

With this arrangement, contact between the at least one heating element and the capillary body may be further improved, leading to a further reduction in the number or severity of "hot spots" on the outer surface of the capillary body and improved aerosol characteristics. Further, by extending into the porous outer surface of the capillary body, the area of contact between the at least one heating element and the capillary body is increased. This may lead to a further improvement in the delivery of liquid aerosol-forming substrate to the heating element by the capillary body and to improved heating of the liquid aerosol-forming substrate by the heating element. It may also improve adhesion between the heating element and the capillary body, further reducing the risk of a loss of contact between the heating element and the capillary body caused by deformation of the heating element, for example during assembly or due to thermal stresses induced during use.

The electrically conductive material from which the at least one heating element is formed may be deposited onto the porous outer surface in any suitable manner. For example, the electrically conductive material may be deposited onto the porous outer surface of the capillary body as a liquid using a dispensing pipette or syringe, or using a fine-tipped transferring device such as a needle.

In some embodiments, the at least one heating element comprises a printable electrically conductive material printed on the porous outer surface of the capillary body. In such embodiments, any suitable known printing technique may be used. For example, one or more of screen-printing, gravure printing, flex-printing, inkjet printing. Such printing processes may be particularly applicable for high speed production processes.

Alternatively, the electrically conductive material, from which the at least one heating element is formed, may be deposited onto the porous outer surface of the capillary body by one or more vacuum deposition processes, such as evaporation deposition and sputtering.

The at least one heating element may be formed from any suitable electrically conductive material. In certain preferred embodiments, the electrically conductive material comprises one or more of a metal, an electrically conductive polymer and an electrically conductive ceramic.

Suitable electrically conductive metals include aluminium, silver, nickel, gold, platinum, copper, tungsten, and alloys thereof. In some embodiments, the electrically conductive material comprises a metal powder suspended in a glue, such as an epoxy resin. In one embodiment, the electrically conductive material comprises silver-loaded epoxy.

Suitable electrically conductive polymers include PEDOT (poly(3,4-ethylenedioxythiophene)), PSS (poly(p-phenylene sulfide)), PEDOT:PSS (mixture of both PEDOT and PSS), PANI (polyanilines), PPY (poly(pyrrole)s), PPV (Poly (p-phenylene vinylene)), or any combination thereof.

Suitable electrically conductive ceramics include ITO (Indium Tin Oxide), SLT (lanthanum-doped strontium titanate), SYT (yttrium-doped strontium titanate), or any combination thereof.

The electrically conductive material may further comprise one or more additives selected from a group consisting of: solvents; curing agents; adhesion promoters; surfactants; viscosity reduction agents; and aggregation inhibitors. Such additives may be used, for example, to aid deposition of the electrically conductive material on the porous outer surface of the capillary body, to increase the amount by which the electrically conductive material diffuses into the porous outer surface of the capillary body, to reduce the time required for the electrically conductive material to set, to increase the level of adhesion between the electrically conductive material and the capillary body, or to reduce the amount of aggregation of suspended particles, such as metal particles or powder, in the electrically conductive material prior to application onto the porous outer surface of the capillary body.

The heating profile of the electric heater may be substantially constant across the porous outer surface of the capillary body.

In some embodiments, the at least one heating element is arranged such that its temperature profile varies across the electric heater.

Advantageously, by varying the temperature profile of the at least one heating element, the heat generated by the electric heater across the outer surface of the capillary body can be tuned according to the characteristics of the cartridge, for example according to the airflow characteristics of the cartridge.

In certain preferred embodiments, the at least one heating element is arranged such that the electric heater generates more heat towards the periphery of the porous outer surface. This allows the electric heater to compensate for heat loss from the periphery of the outer surface, for example heat loss due to thermal conduction, resulting in more uniform temperature across the porous outer surface.

The heating profile of the electric heater may be varied across the porous outer surface by varying the distribution of the at least one heating element across the porous outer surface. For example, the heating profile of the electric heater may be increased towards the centre of the porous outer surface by increasing the distribution density of the at least one heating element towards the centre of the porous outer surface. As used herein, the term "distribution density" refers to the proportion of the porous outer surface on which the electrically conductive material of the at least one heating element is deposited. For example, a 50 percent distribution density in a particular area of the porous outer surface would indicate that the electrically conductive material is deposited on 50 percent of that area and not on the remaining 50 percent of that area.

The heating profile of the electric heater may be varied across the porous outer surface by varying the resistance of the heating element across the porous outer surface.

In some embodiments, the resistance of the at least one heating element decreases towards the centre of the porous outer surface to vary the heating profile of the electric heater across the porous outer surface. With this arrangement, the electric heater generates more heat towards the periphery of the porous outer surface of the capillary body. This may allow the electric heater to compensate for heat loss from the periphery of the outer surface of the capillary body, for example heat loss due to thermal conduction, resulting in more uniform temperature across the porous outer surface of the capillary body.

The resistance of the at least one heating element may be varied by using a plurality of heating elements formed from electrically conductive materials having different resistivity values. For example, the resistance of the at least one heating element may be decreased towards the centre of the porous outer surface by arranging the plurality of heating elements on the porous outer surface such that the resistivity of at least one of the heating elements towards the periphery of the porous outer surface of the capillary body is greater than the resistivity of at least one of the heating elements towards the centre of the porous outer surface of the capillary body.

In some embodiments, the cross-sectional area of the at least one heating element varies. This allows the temperature profile of the at least one heating element to be tuned according to the characteristics of the cartridge, since the resistance of the at least one heating element is inversely proportional to its cross-sectional area. In such embodiments, the at least one heating element may comprise a heating element having a cross-sectional area which varies along the length of the heating element. Alternatively, or in addition, the at least one heating element may comprise a first heating element having a first cross-sectional area and a second heating element having a second cross-sectional area which is different to the first cross-sectional area.

In certain preferred embodiments, the cross-sectional area of the at least one heating element increases towards the centre of the porous outer surface. This results in more heat generation from the at least one heating element towards the periphery of the porous outer surface. This allows the electric heater to compensate for heat loss from the periphery of the outer surface, for example heat loss due to thermal conduction, resulting in more uniform temperature across the porous outer surface.

The cross-sectional area of the at least one heating element may be varied by varying the thickness of the at least one heating element, or the width of the at least one heating element, or both the thickness and the width of the at least one heating element.

As used herein, the terms "vary", "varies", "differ", "differs, and "different" refer to deviations beyond that of standard manufacturing tolerances and in particular to values that deviate from each other by at least 5 percent.

As used herein, the term "thickness" refers to the dimension of the heating element in a direction perpendicular to the porous outer surface of the capillary body and perpendicular to the length of the heating element.

As used herein, the term "width" refers to the dimension of the heating element in a direction parallel to the porous outer surface of the capillary body and perpendicular to the length of the heating element.

In any of the embodiments described above, adjacent parts of the at least one heating element may be spaced apart to define a plurality of apertures in the electric heater, wherein the size of the apertures varies to vary the temperature profile of the electric heater. In such embodiments, the at least one heating element may comprise a plurality of heating elements which are spaced apart to define the plurality of apertures. Alternatively, or in addition, the at least one heating element may comprise one or more heating elements which form a non-linear shape such that adjacent sections of the one or more heating elements are spaced apart to define the plurality of apertures.

In certain preferred embodiments, the size of the apertures is smaller towards the periphery of the porous surface of the capillary body.

This may result in more heat generation from the at least one heating element towards the periphery of the porous outer surface. This allows the electric heater to compensate for heat loss from the periphery of the outer surface, for example heat loss due to thermal conduction, resulting in more uniform temperature across the porous outer surface. This arrangement also enables more aerosol to pass through the electric heater in the centre portion of the porous outer surface and may be advantageous in heater assemblies in which the centre of the porous surface is the most important vaporization area. For example, the mean size of the apertures in the peripheral portion of the porous outer surface of the capillary body is at least 10 percent less than the mean size of the apertures outside of the peripheral portion of the porous outer surface of the capillary body, preferably at least 20 percent less, more preferably at least 30 percent less. The peripheral portion may have an area of less than about 80 percent of the total area of the porous outer surface of the capillary body, preferably less than about 60 percent, more preferably less than about 40 percent, most preferably less than about 20 percent.

The electric heater may comprise a single heating element. Alternatively, the electric heater may comprise a plurality of heating elements connected in series or parallel. In such embodiments, the plurality of heating elements may be formed from the same electrically conductive material.

Alternatively, the electric heater may comprise at least one first heating element formed from a first electrically conductive material and at least one second heating element formed from a second electrically conductive material different to the first electrically conductive material, the first and second electrically conductive materials being deposited directly onto the porous outer surface of the capillary body. Preferably, the resistivity of the first electrically conductive material differs from the resistivity of the second electrically conductive material.

Advantageously, this allows the temperature profile of the at least one heating element and, thus, the heat generated by the electric heater across the outer surface of the capillary body to be tuned according to the desired characteristics.

In certain preferred embodiments, the electric heater comprises a plurality of heating elements formed from electrically conductive materials having different resistivity values. In such embodiments, the plurality of heating elements may be arranged such that the resistivity of at least one of the heating elements towards the periphery of the porous outer surface of the capillary body is greater than the resistivity of at least one of the heating elements towards the centre of the porous outer surface of the capillary body. With this arrangement, the electric heater generates more heat towards the periphery of the porous outer surface of the capillary body. This allows the electric heater to compensate for heat loss from the periphery of the outer surface of the capillary body, for example heat loss due to thermal conduction, resulting in more uniform temperature across the porous outer surface of the capillary body.

The electric heater may comprise a plurality of heating elements formed from a plurality of different electrically conductive materials. In some embodiments, the electric heater comprises a plurality of heating elements, each formed from a different electrically conductive material.

One or more of the heating elements may be formed from a material having a resistance that varies significantly with temperature, such as an iron aluminium alloy. This allows a measure of resistance of the heating elements to be used to determine temperature or changes in temperature. This can be used in a puff detection system and for controlling The electric heater may comprise first and second electrically conductive contact portions in electrical contact with the at least one heating element. In such embodiments, the first and second electrically conductive contact portions may be formed from an electrically conductive material deposited directly onto the porous outer surface of the capillary body.

In some embodiments, substantially the entire electric heater is formed from one or more electrically conductive materials deposited directly onto the porous outer surface of the capillary body.

The electrical resistance of the electric heater is preferably between 0.3 and 4 Ohms. More preferably, the electrical resistance of the electric heater is between 0.5 and 3 Ohms, and more preferably about 1 Ohm.

Where the electric heater comprises electrically conductive contact portions for contacting the at least one heating element, the electrical resistance of the at least one heating element is preferably at least an order of magnitude, and more preferably at least two orders of magnitude, greater than the electrical resistance of the contact portions. This ensures that the heat generated by passing current through the electric heater is localised to the at least one heating element. It is generally advantageous to have a low overall resistance for the electric heater if the cartridge is to be used with an aerosol-generating system powered by a battery. Minimizing parasitic losses between the electrical contacts and the heating elements is also desirable to minimize parasitic power losses. A low resistance, high current system allows for the delivery of high power to the electric heater. This allows the heater to heat the heating elements to a desired temperature quickly.

The electrically conductive contact portions may be fixed directly to the at least one heating element. Alternatively, the electrically conductive contact portions may be integral with the at least one heating element. The provision of electrically conductive contact portions that are integral with the at least one heating element allows for reliable and simple connection of the electric heater to a power supply.

The capillary body may be a capillary wick or other type or shape of capillary body, such as a capillary tube. In preferred embodiments, the capillary body comprises a capillary material. The capillary material may comprise any suitable material or combinations of materials. The capillary body may comprise a single capillary material.

In some embodiments, the capillary body includes a first capillary material and a second capillary material, wherein the at least one heating element is formed from an electrically conductive material deposited directly onto a porous outer surface of the first capillary material, and wherein the second capillary material is in contact with the first capillary material and spaced apart from the electric heater by the first capillary material, the first capillary material having a higher thermal decomposition temperature than the second capillary material. The first capillary material effectively acts as a spacer separating the at least one heating element from the second capillary material so that the second capillary material is not exposed to temperatures above its thermal decomposition temperature. In some embodiments, the thermal decomposition temperature of the first capillary material is at least 160 degrees Celsius, and preferably at least 250 degrees Celsius.

As used herein, "thermal decomposition temperature" means the temperature at which a material begins to decompose and lose mass by generation of gaseous by products.

The second capillary material may advantageously occupy a greater volume than the first capillary material and may hold more aerosol-forming substrate than the first capillary material. The second capillary material may have superior wicking performance to the first capillary material. The second capillary material may be a less expensive or have a higher filling capability than the first capillary material. The second capillary material may be polypropylene.

The first capillary material may separate the electric heater from the second capillary material by a distance of at least 1.5 millimetres, and preferably between 1.5 millimetres and 2 millimetres in order to provide a sufficient temperature drop across the first capillary material.

Where the capillary body comprises a capillary material, the capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid to the heater. Alternatively, the capillary material may comprise sponge-like or foam-like material. The structure of the capillary material forms a plurality of small bores or tubes, through which the liquid can be transported by capillary action. The capillary material or materials may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid has physical properties, including but not limited to viscosity, surface tension, density, thermal conductivity, boiling point and vapour pressure, which allow the liquid to be transported through the capillary device by capillary action.

According to a second aspect of the present invention, there is provided a cartridge for use in an aerosol-generating system, the cartridge comprising a liquid storage portion for holding a liquid aerosol-forming substrate; and a heater assembly according to any of the embodiments described above.

In alternative embodiments, the heater assembly may be provided as an integral part of an aerosol-generating system, rather than forming part of a cartridge for use in the aerosol-generating system.

The liquid storage portion of the cartridge may be provided by the capillary body. For example, the capillary body may be made from a high retention capillary material which forms a liquid storage portion of the cartridge. Alternatively, the liquid storage portion and the capillary body may be distinct components of the cartridge.

Where the liquid storage portion and the capillary body are distinct components of the cartridge, in certain embodiments, the capillary body comprises a first end extending into the liquid storage portion for contact with the liquid therein and a porous second end opposite to the first end, wherein the at least one heating element is formed from an electrically conductive material deposited directly onto the second end of the capillary body. Alternatively, the first end of the capillary body may be outside of the liquid storage portion and the capillary body may comprise at least one other porous surface for contact with the liquid in the liquid storage portion. For example, the capillary body may comprise one or more porous side walls of the capillary body for contact with the liquid in the liquid storage portion and via which the liquid aerosol-forming substrate is conveyed from the liquid storage portion to the electric heater.

The liquid storage portion may include a housing for holding a liquid aerosol-forming substrate, the housing having the opening, wherein the capillary body is arranged such that the electric heater extends across the opening.

The cartridge may comprise a liquid storage portion comprising a housing for holding a liquid aerosol-forming substrate, the housing having an opening. The housing may be a rigid housing and impermeable to fluid. As used herein "rigid housing" means a housing that is self-supporting. The capillary body may be a capillary material contained in the housing of the storage portion.

The housing may contain two or more different capillary materials, wherein a first capillary material, in contact with the at least one heating element, has a higher thermal decomposition temperature and a second capillary material, in contact with the first capillary material but not in contact with the at least one heating element has a lower thermal decomposition temperature. The first capillary material effectively acts as a spacer separating the heating element from the second capillary material so that the second capillary material is not exposed to temperatures above its thermal decomposition temperature. As used herein, "thermal decomposition temperature" means the temperature at which a material begins to decompose and lose mass by generation of gaseous by products. The second capillary material may advantageously occupy a greater volume than the first capillary material and may hold more aerosol-forming substrate that the first capillary material. The second capillary material may have superior wicking performance to the first capillary material. The second capillary material may be a less expensive or have a higher filling capability than the first capillary material. The second capillary material may be polypropylene.

Where the liquid storage portion comprises a housing having an opening, the at least one heating element may extends across the full length dimension of the opening of the housing. The width dimension is the dimension perpendicular to the length dimension in the plane of the opening. Preferably the at least one heating element has a width that is smaller than the width of the opening of the housing. Preferably the electric heater is spaced apart from the perimeter of the opening. The width of the at least one heating element may be less than the width of the opening in at least a region of the opening. The width of the at least one heating element may be less than the width of the opening in all of the opening. The width of the at least one heating element may be less than 90 percent, for example less than 50 percent, for example less than 30 percent, for example less than 25 percent of the width of the opening of the housing. The area of the at least one heating element may be less than 90 percent, for example less than 50 percent, for example less than 30 percent, for example less than 25 percent of the area of the opening of the housing. The area of the at least one heating element may be for example between 10 percent and 50 percent of the area of the opening, preferably between 15 and 25 percent of the area of the opening. The open area of the at least one heating element, which is the ratio of the area of the apertures to the total area of the electric heater is preferably from about 25 percent to about 56 percent. The opening may be of any appropriate shape. For example the opening may have a circular, square or rectangular shape. The area of the opening may be small, preferably less than or equal to about 25 millimetres squared. The spacing between the heating element and the opening periphery is preferably dimensioned such that the thermal contact is significantly reduced. The spacing between the heating element and the opening periphery may be between 25 microns and 40 microns.

The at least one heating element is preferably arranged in such a way that the physical contact area with the liquid storage portion is reduced compared with a case in which the heating elements of the electric heater is in contact around the whole of the periphery of the liquid storage portion. The at least one heating element preferably does not directly contact the perimeter of the liquid storage portion. In this way thermal contact to the liquid storage portion is reduced and heat losses to the liquid storage portion and further adjacent elements, for example those of an aerosol-generating system in which the cartridge is used, are reduced.

Without wishing to be bound by any particular theory, it is believed that by spacing the heating element away from the liquid storage portion, less heat is transferred to the liquid storage portion, thus increasing efficiency of heating and therefore aerosol generation.

The electric heater may comprise a single heating element, or a plurality of heating elements connected in parallel or in series. Where the electric heater comprises at least first and second electrically conductive contact portions for contacting the at least one heating element, the first and second electrically conductive contact portions may be arranged such that the first contact portion contacts the first heating element and the second contact portion contacts the last heating element of the serially connected heating elements. Additional contact portions may be provided to allow for serial connection of all heating elements.

Where the electric heater includes a plurality of heating elements, the heating elements may be spatially arranged substantially in parallel to each other. Preferably the heating elements are spaced apart from each other. Without wishing to be bound by any particular theory, it is thought that spacing the heating elements apart from each other may give more efficient heating. By appropriate spacing of the heating elements for example, a more even heating across the area of the opening may be obtained compared with for example where a single heating element having the same area is used.

Where the electric heater includes a plurality of heating elements, at least one of the plurality of heating elements may comprise a first material and at least one other of the plurality of heating elements may comprise a second material different from the first material. This may be beneficial for electrical or mechanical reasons. For example, one or more of the heating elements may be formed from a material having a resistance that varies significantly with temperature, such as an iron aluminium alloy. This allows a measure of resistance of the heating elements to be used to determine temperature or changes in temperature. This can be used in a puff detection system and for controlling heater temperature to keep it within a desired temperature range.

The at least one heating element may comprise an array of electrically conductive filaments extending along the length of the at least one heating element, a plurality of apertures being defined by interstices between the electrically conductive filaments. In such embodiments, the size of the plurality of apertures may be varied by increasing or decreasing the size of the interstices between adjacent filaments. This may be achieved by varying the width of the electrically conductive filaments, or by varying the interval between adjacent filaments, or by varying both the width of the electrically conductive filaments and the interval between adjacent filaments.

As used herein, the term "filament" refers to an electrical path arranged between two electrical contacts. A filament may arbitrarily branch off and diverge into several paths or filaments, respectively, or may converge from several electrical paths into one path. A filament may have a round, square, flat or any other form of cross-section. In preferred embodiments, the filaments have a substantially flat cross-section. A filament may be arranged in a straight or curved manner.

The electrically conductive filaments may be substantially flat.

As used herein, "substantially flat" preferably means formed in a single plane and for example not wrapped around or other conformed to fit a curved or other non-planar shape. A flat electric heater can be easily handled during manufacture and provides for a robust construction.

The liquid aerosol-forming substrate is a liquid substrate capable of releasing volatile compounds that can form an aerosol. The volatile compounds may be released by heating the aerosol forming substrate.

The aerosol-forming substrate is a liquid. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material. The aerosol-forming substrate may comprise homogenised tobacco material. The aerosol-forming substrate may comprise at least one aerosol-former. An aerosol-former is any suitable known compound or mixture of compounds that, in use, facilitates formation of a dense and stable aerosol and that is substantially resistant to thermal degradation at the operating temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The aerosol-forming substrate may comprise other additives and ingredients, such as flavourants.

According to a third aspect of the present invention, there is provided an aerosol-generating system comprising: an aerosol-generating device; and a cartridge according to any of the embodiments described above, wherein the cartridge is removably coupled to the aerosol-generating device, and wherein the aerosol-generating device includes a power supply for the electric heater.

As used herein, the cartridge being "removably coupled" to the device means that the cartridge and device can be coupled and uncoupled from one another without damaging either the device or the cartridge.

The cartridge can be exchanged after consumption. As the cartridge holds the aerosol forming substrate and the electric heater, the electric heater is also exchanged regularly such that the optimal vaporization conditions are maintained even after longer use of the main unit.

The aerosol-generating system may further comprise electrical circuitry connected to the electric heater and to an electrical power source, the electric circuitry being configured to monitor an electrical resistance of the electric heater and to control supply of power from the electrical power source to the electric heater based on the monitored electrical resistance. For example, the electric circuitry may be configured to monitor an electrical resistance of one or more heating element. By monitoring the temperature of the electric heater, the system can prevent over- or underheating of the electric heater and ensure that optimal vaporization conditions are provided.

The electric circuitry may comprise a microprocessor, which may be a programmable microprocessor, a microcontroller, or an application specific integrated chip (ASIC) or other electronic circuitry capable of providing control. The electric circuitry may comprise further electronic components. The electric circuitry may be configured to regulate a supply of power to the heater. Power may be supplied to the electric heater continuously following activation of the system or may be supplied intermittently, such as on a puff by puff basis. The power may be supplied to the electric heater in the form of pulses of electrical current.

The aerosol-generating device includes a power supply for the electric heater of the cartridge. The power source may be a battery, such as a lithium iron phosphate battery, within the device. As an alternative, the power supply may be another form of charge storage device such as a capacitor. The power supply may require recharging and may have a capacity that allows for the storage of enough energy for one or more smoking experiences. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater.

The liquid storage portion may be positioned on a first side of the electric heater and an airflow channel positioned on an opposite side of the electric heater to the storage portion, such that air flow past the electric heater entrains vapourised aerosol-forming substrate.

The system may be an electrically operated smoking system. The system may be a handheld aerosol-generating system. The aerosol-generating system may have a size comparable to a conventional cigar or cigarette. The smoking system may have a total length between approximately 30 millimetres and approximately 150 millimetres. The smoking system may have an external diameter between approximately 5 millimetres and approximately 30 millimetres.

According to a fourth aspect of the present invention, there is provided a method of manufacturing a cartridge for use in an aerosol-generating system, the method comprising the steps of: providing a liquid storage portion for holding a liquid aerosol-forming substrate; providing a capillary body having a porous outer surface; forming an electric heating element by depositing an electrically conductive material directly onto the porous outer surface of the capillary body; filling the liquid storage portion with liquid aerosol-forming substrate; and connecting the capillary body to the liquid storage portion such that liquid aerosol-forming substrate contained in the liquid storage portion is conveyed from the liquid storage portion to the electric heating element by the capillary body.

The liquid storage portion of the cartridge may be provided by the capillary body. For example, the capillary body may be made from a high retention capillary material which forms a liquid storage portion of the cartridge. Alternatively, the liquid storage portion and the capillary body may be distinct components of the cartridge.

Where the liquid storage portion and the capillary body are distinct components of the cartridge, in certain embodiments, the capillary body comprises a first end extending into the liquid storage portion for contact with the liquid therein and a porous second end opposite to the first end, wherein the at least one heating element is formed from an electrically conductive material deposited directly onto the second end of the capillary body. Alternatively, the first end of the capillary body may be outside of the liquid storage portion and the capillary body may comprise at least one other porous surface for contact with the liquid in the liquid storage portion. For example, the capillary body may comprise one or more porous side walls of the capillary body for contact with the liquid in the liquid storage portion and via which the liquid aerosol-forming substrate is conveyed from the liquid storage portion to the electric heater.

The liquid storage portion may include a housing for holding a liquid aerosol-forming substrate, the housing having the opening, wherein the capillary body is arranged such that the electric heater extends across the opening.

The electrically conductive material from which the at least one heating element is formed may be deposited onto the porous outer surface in any suitable manner. For example, the electrically conductive material may be deposited onto the porous outer surface of the capillary body as a liquid using a dispensing pipette or syringe, or using a fine-tipped transferring device such as a needle. In certain embodiments, the electrically conductive material is deposited directly onto the porous outer surface of the capillary body by one or more vacuum deposition methods, such as evaporation deposition and sputtering.

In preferred embodiments, the electrically conductive material is deposited by printing a printable electrically conductive material directly onto the porous outer surface of the capillary body. In such embodiments, any suitable known printing technique may be used. For example, one or more of screen-printing, gravure printing, flex-printing, inkjet printing may be used. Such printing processes may be particularly advantageous when used in high speed production processes.

The printable electrically conductive material may comprise any suitable electrically conductive material. In certain preferred embodiments, the electrically conductive material comprises one or more of a metal, an electrically conductive polymer and an electrically conductive ceramic.

Suitable electrically conductive metals include aluminium, silver, nickel, gold, platinum, copper, tungsten, and alloys thereof. In some embodiments, the electrically conductive material comprises a metal powder suspended in a glue, such as an epoxy resin. In one embodiment, the electrically conductive material comprises silver-loaded epoxy.

Suitable electrically conductive polymers include PEDOT (poly(3,4-ethylenedioxythiophene)), PSS (poly(p-phenylene sulfide)), PEDOT:PSS (mixture of both PEDOT and PSS), PANI (polyanilines), PPY (poly(pyrrole)s), PPV (Poly (p-phenylene vinylene)), or any combination thereof.

Suitable electrically conductive ceramics include ITO (Indium Tin Oxide), SLT (lanthanum-doped strontium titanate), SYT (yttrium-doped strontium titanate), or any combination thereof.

The printable electrically conductive material may further comprise one or more additives selected from a group consisting of: solvents; curing agents; adhesion promoters; surfactants; viscosity reduction agents; and aggregation inhibitors. Such additives may be used, for example, to aid deposition of the electrically conductive material on the porous outer surface of the capillary body, to increase the amount by which the electrically conductive material diffuses into the porous outer surface of the capillary body, to reduce the time required for the electrically conductive material to set, to increase the level of adhesion between the electrically conductive material and the capillary body, or to reduce the amount of aggregation of suspended particles, such as metal particles or powder, in the electrically conductive material prior to application onto the porous outer surface of the capillary body.

Having been printed on the porous outer surface of the capillary body, the printed electrically conductive material may be cured in any suitable known manner to form the at least one heating element. For example, the printed electrically conductive material may be cured by exposure to heat or to ultraviolet light. Alternatively, or in addition, the printed electrically conductive material may be cured by sintering or by initiating a chemical reaction. In one particular embodiment, the printed electrically conductive material comprises copper and is cured to form the at least one heating element by initiating a chemical reaction.

In certain embodiments, the method further comprises the step of heat treating the electrically conductive material to increase the electrical conductivity of the at least one heating element. In one particular embodiment, the electrically conductive material comprises an electrically conductive ceramic, such as Indium-Tin Oxide, and the method further comprises the step of heat treating the electrically conductive material to grow micro-crystal grains of the ceramic and thereby increase its electrical conductivity.

Features described in relation to one or more aspects may equally be applied to other aspects of the invention. In particular, features described in relation to the heater assembly of the first aspect may be equally applied to the cartridge of the second aspect, and vice versa, and features described in relation to the heater assembly of the first aspect or the cartridge of the second aspect may equally apply to the aerosol-generating system of the third aspect or the method of manufacture of the fourth aspect.

FIGS. 1A to 1D are schematic illustrations of an aerosol-generating system, including a cartridge in accordance with an embodiment of the invention. FIG. 1A is a schematic view of an aerosol-generating device 10, or main unit, and a separate cartridge 20, which together form the aerosol generating system. In this example, the aerosol-generating system is an electrically operated smoking system.

The cartridge 20 contains an aerosol-forming substrate and is configured to be received in a cavity 18 within the device. Cartridge 20 should be replaceable by a user when the aerosol-forming substrate provided in the cartridge is depleted. FIG. 1A shows the cartridge 20 just prior to insertion into the device, with the arrow 1 in FIG. 1A indicating the direction of insertion of the cartridge.

Figure 1B:
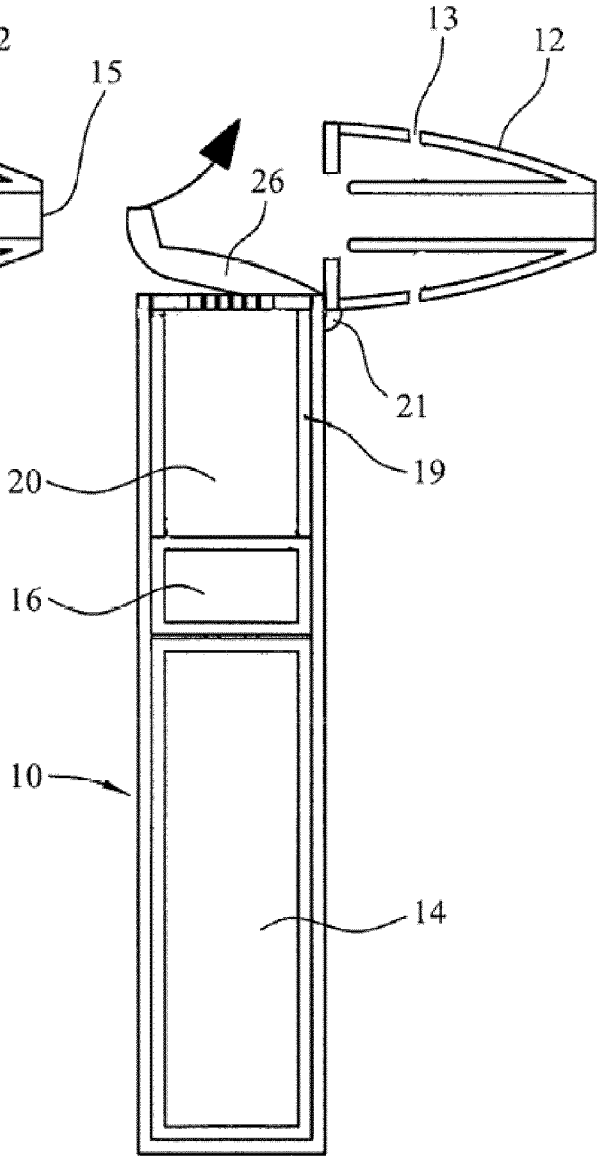
Figure 1C:
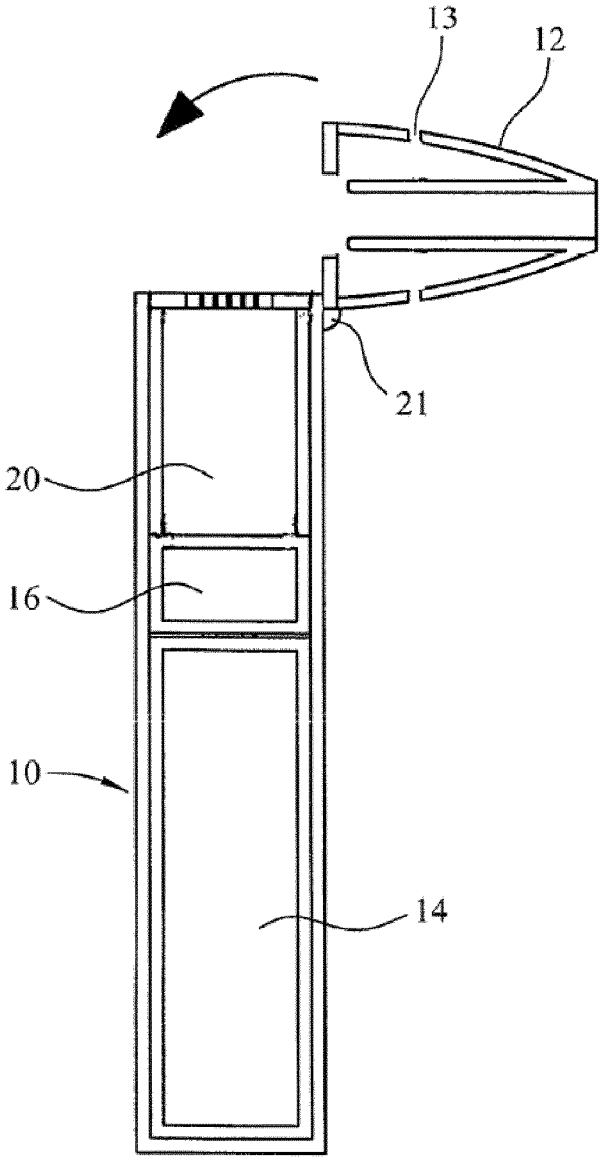
Figure 1D:
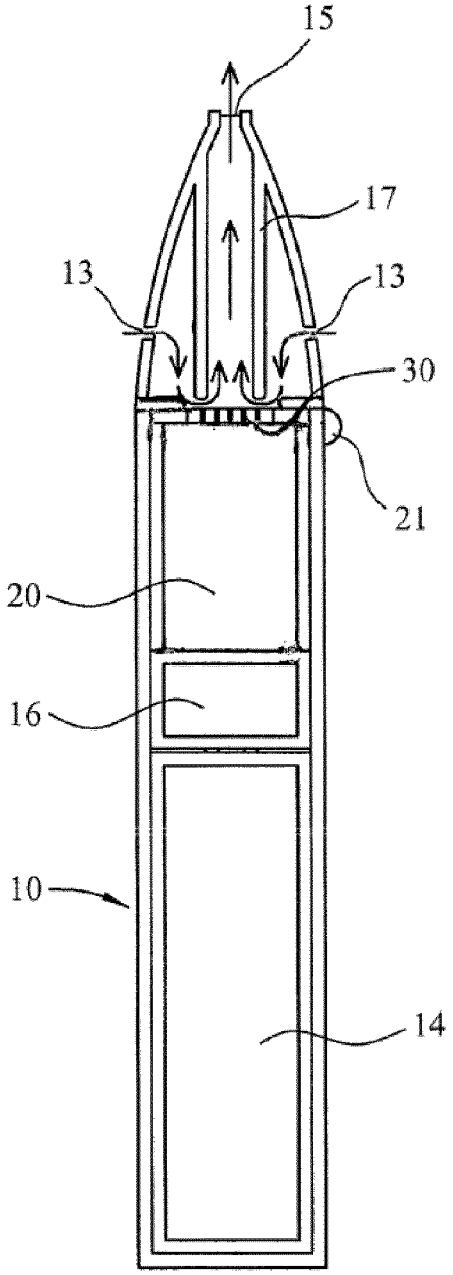

The aerosol-generating device 10 is portable and has a size comparable to a conventional cigar or cigarette. The device 10 comprises a main body 11 and a mouthpiece portion 12. The main body 11 contains a battery 14, such as a lithium iron phosphate battery, control electronics 16 and a cavity 18. The mouthpiece portion 12 is connected to the main body 11 by a hinged connection 21 and can move between an open position as shown in FIGS. 1A to 1C and a closed position as shown in FIG. 1D. The mouthpiece portion 12 is placed in the open position to allow for insertion and removal of cartridges 20 and is placed in the closed position when the system is to be used to generate aerosol, as will be described. The mouthpiece portion comprises a plurality of air inlets 13 and an outlet 15. In use, a user sucks or puffs on the outlet to draw air from the air inlets 13, through the mouthpiece portion to the outlet 15, and thereafter into the mouth or lungs of the user. Internal baffles 17 are provided to force the air flowing through the mouthpiece portion 12 past the cartridge, as will be described.

The cavity 18 has a circular cross-section and is sized to receive a housing 24 of the cartridge 20. Electrical connectors 19 are provided at the sides of the cavity 18 to provide an electrical connection between the control electronics 16 and battery 14 and corresponding electrical contacts on the cartridge 20.

FIG. 1B shows the system of FIG. 1A with the cartridge inserted into the cavity 18, and the cover 26 being removed. In this position, the electrical connectors rest against the electrical contacts on the cartridge, as will be described.

FIG. 1C shows the system of FIG. 1B with the cover 26 fully removed and the mouthpiece portion 12 being moved to a closed position.

FIG. 1D shows the system of FIG. 10 with the mouthpiece portion 12 in the closed position. The mouthpiece portion 12 is retained in the closed position by a clasp mechanism (not illustrated). It will be apparent to a person of ordinary skill in the art that other suitable mechanisms for retaining the mouthpiece in a closed position may be used, such as a snap fitting or a magnetic closure.

The mouthpiece portion 12 in a closed position retains the cartridge in electrical contact with the electrical connectors 19 so that a good electrical connection is maintained in use, whatever the orientation of the system is. The mouthpiece portion 12 may include an annular elastomeric element that engages a surface of the cartridge and is compressed between a rigid mouthpiece housing element and the cartridge when the mouthpiece portion 12 is in the closed position. This ensures that a good electrical connection is maintained despite manufacturing tolerances.

Of course other mechanisms for maintaining a good electrical connection between the cartridge and the device may, alternatively or in addition, be employed. For example, the housing 24 of the cartridge 20 may be provided with a thread or groove (not illustrated) that engages a corresponding groove or thread (not illustrated) formed in the wall of the cavity 18. A threaded engagement between the cartridge and device can be used to ensure the correct rotational alignment as well as retaining the cartridge in the cavity and ensuring a good electrical connection. The threaded connection may extend for only half a turn or less of the cartridge, or may extend for several turns. Alternatively, or in addition, the electrical connectors 19 may be biased into contact with the contacts on the cartridge.

Figure 2:
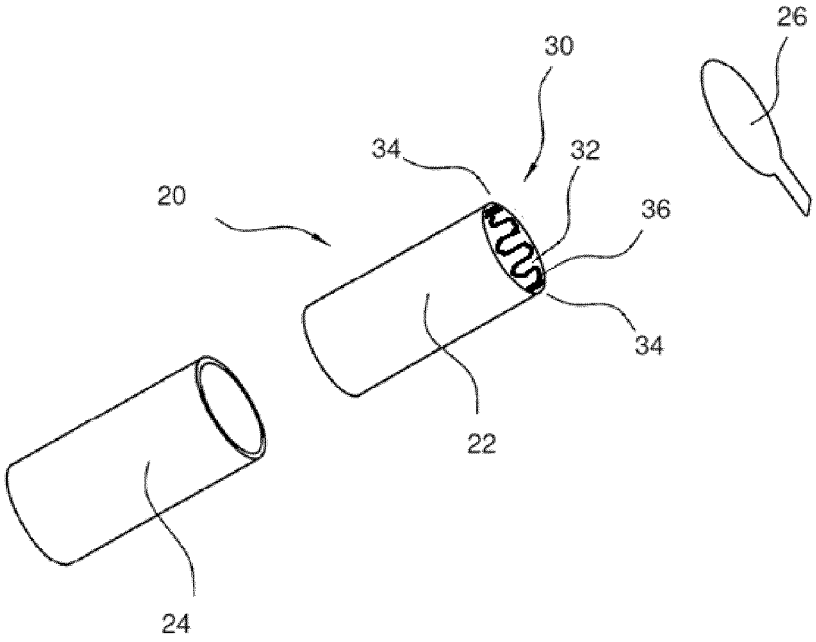
FIG. 2 is an exploded view of the cartridge of the system shown in FIG. 1.

FIG. 2 is an exploded view of a cartridge 20 suitable for use in an aerosol-generating system, for example an aerosol-generating system of the type of FIG. 1. The cartridge 20 comprises a generally circular cylindrical housing 24 that has a size and shape selected to be received into a corresponding cavity of, or mounted in an appropriate way with other elements of the aerosol-generating system, for example cavity 18 of the system of FIG. 1. The housing 24 has an open end and contains an aerosol-forming substrate. In this example, the aerosol-forming substrate is a liquid and the housing 24 further contains a capillary body comprising a capillary material 22 that is soaked in the liquid aerosol-forming substrate. In this example the aerosol-forming substrate comprises 39 percent by weight glycerine, 39 percent by weight propylene glycol, 20 percent by weight water and flavourings, and 2 percent by weight nicotine. A capillary material is a material that actively conveys liquid from one end to another, and may be made from any suitable material. In this example the capillary material is formed from polyester. In other examples, the aerosol-forming substrate may be a solid.

The capillary material 22 has a porous outer surface 32 to which an electric heater 30 is fixed. The heater 30 comprises a pair of electrical contacts 34 fixed on opposite sides of the porous outer surface 32 and a heating element 36 fixed to the outer surface 32 and to the electrical contacts 34. In this example, heater 30 comprises a single heating element 36 extending between the electrical contacts 34 and having a meander or zig-zag arrangement. However, it will now be apparent to one of ordinary skill in the art that other arrangements of heater may also be used. For example, the heater may comprise a single heating element in a double spiral shape, or following a more complex, tortuous path, or following a substantially linear path. Equally, the heater may comprise a plurality of heating elements, for example a plurality of substantially parallel heating elements.

The electrical contacts 34 and the heater element 36 are integrally formed from an electrically conductive material that has been deposited as a liquid directly onto the porous outer surface 32 and subsequently dried. As the outer surface 32 is porous, the electrically conductive material diffuses into the outer surface 32 during deposition such that, when the electrically conductive material dries, the heater 30 is fixed securely to the capillary material 22. The diffusion of the electrically conductive material into the outer surface 32 also increases the area of contact between the heating element 36 and the capillary material 22, thereby improving the efficiency of heat transfer from the heating element 36 to the capillary material 22.

The heater 30 is covered by a removable cover 26. The cover 26 comprises a liquid impermeable plastic sheet that is glued over the heater assembly but which can be easily peeled off. A tab is provided on the side of the cover 26 to allow a user to grasp the cover when peeling it off. It will now be apparent to one of ordinary skill in the art that although gluing is described as the method to a secure the impermeable plastic sheet, other methods familiar to those in the art may also be used including heat sealing or ultrasonic welding, so long as the cover 26 may easily be removed by a consumer.

It will be understood that other cartridge designs are possible. For example, the capillary material with the cartridge may comprise two or more separate capillary materials, or the cartridge may comprise a tank for holding a reservoir of free liquid.

The heater filaments of the heater element 36 are exposed through the opening 35 in the substrate 34 so that vapourised aerosol-forming substrate can escape into the airflow past the heater assembly.

In use, the cartridge 20 is placed in the aerosol-generating system, and the heater assembly 30 is contacted to a power source comprised in the aerosol-generating system. An electronic circuitry is provided to power the heater element 36 and to volatilize the aerosol-generating substrate. Vapourised aerosol-forming substrate can then escape into the airflow past the heater 30.

Figure 3A:
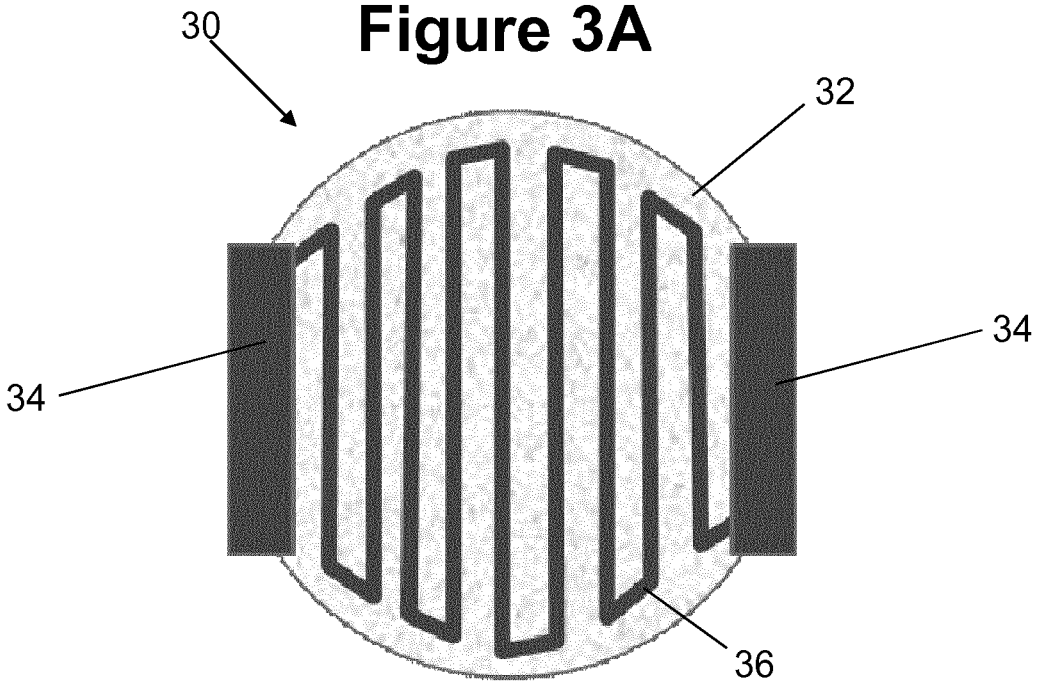
FIGS. 3A to 3E show first to fifth example heater assemblies.
Figure 3B:
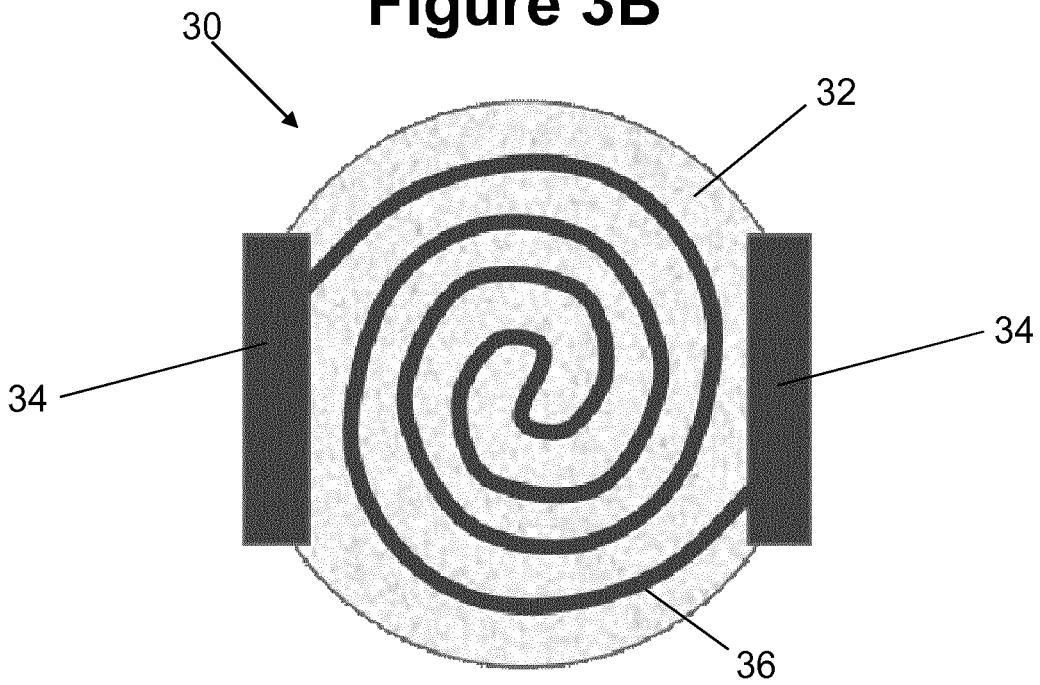
Figure 3C:
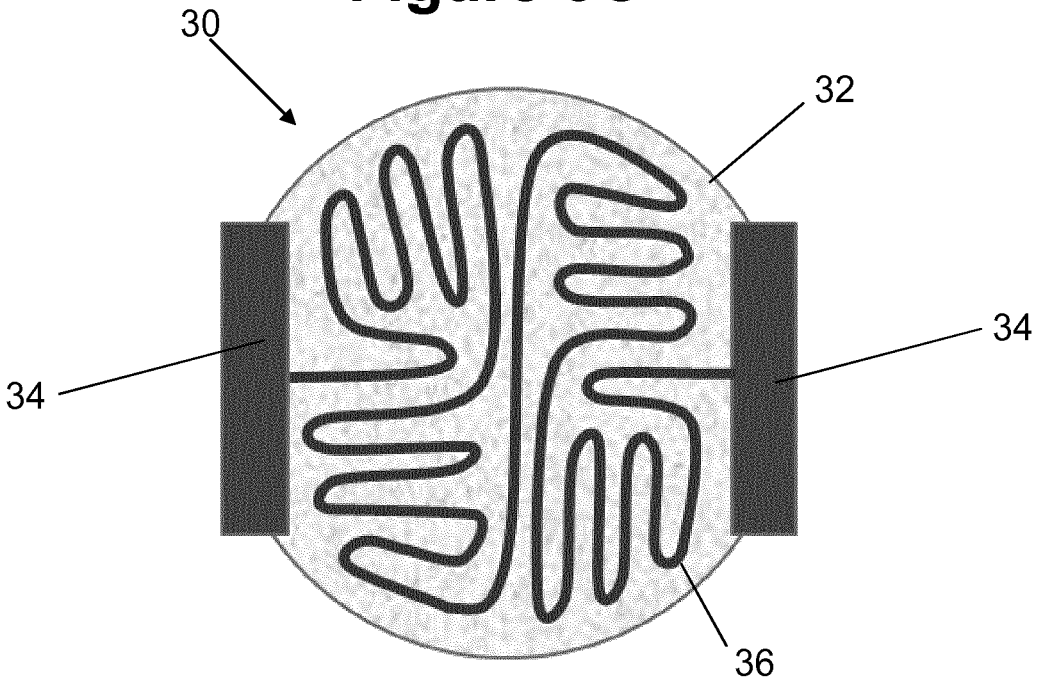
Figure 3D:
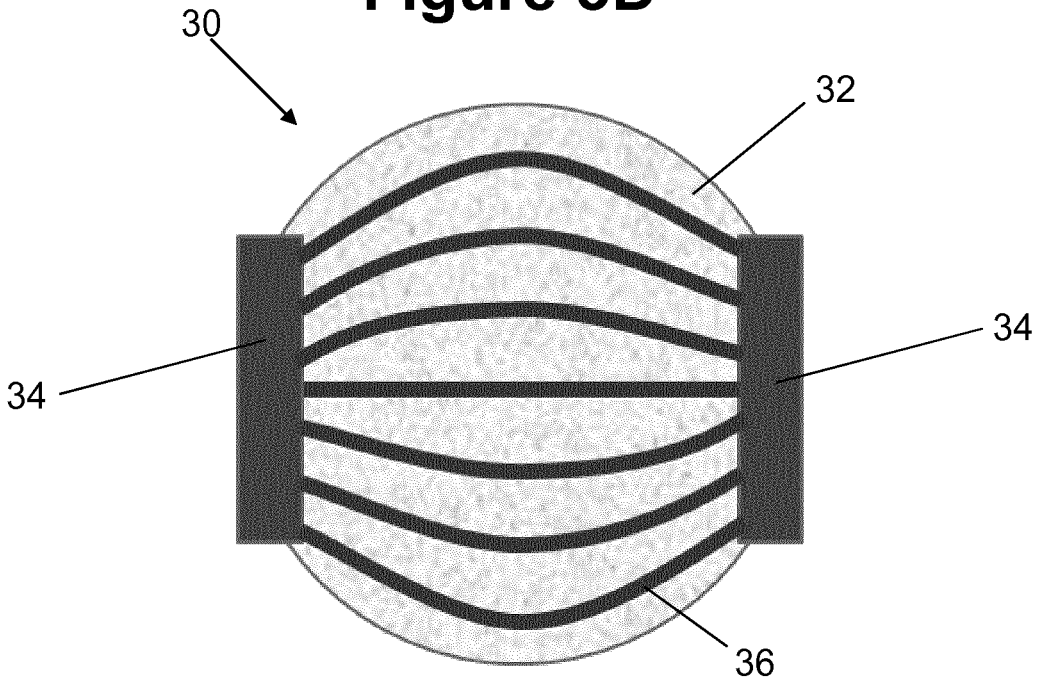
Figure 3E:
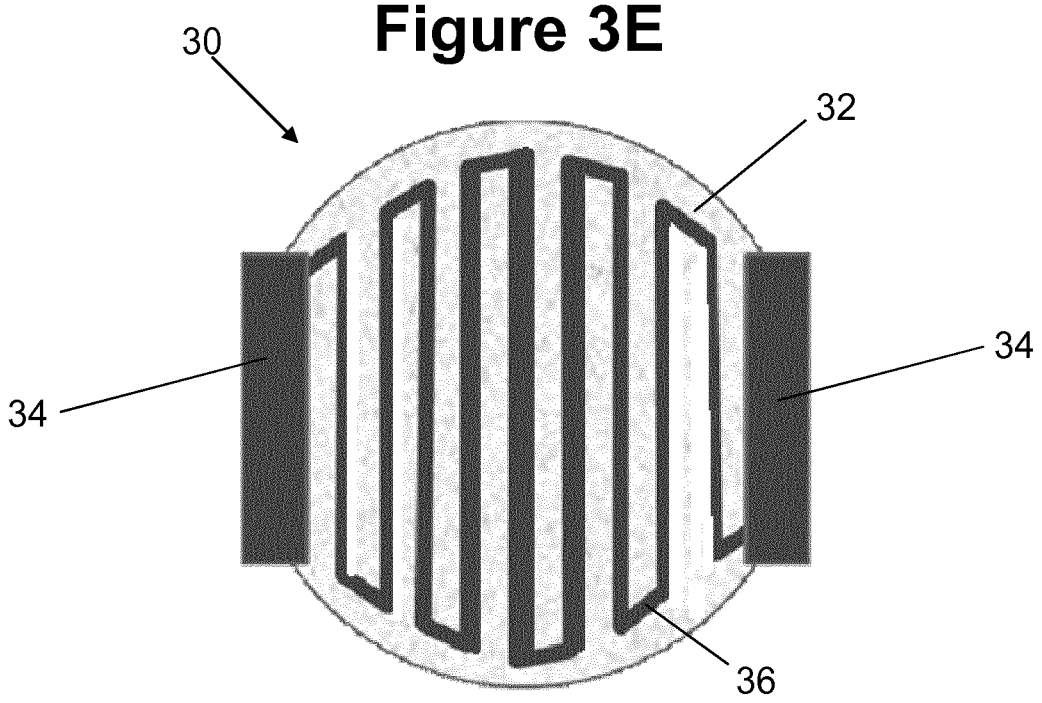

In FIGS. 3A to 3E, first to fifth examples of electric heater 30 arrangement are depicted. In the first example, as shown in FIG. 3A, the heater 30 comprises diametrically opposed electrical contacts 34 and a single heating element 36 connected to the electrical contacts 34 and extending between the electrical contacts 34 along a meandering or zig-zag path. In the second example, as shown in FIG. 3B, the heater 30 comprises diametrically opposed electrical contacts 34 and a single heating element 36 connected to the electrical contacts 34 and extending between the electrical contacts 34 along a double spiral path. In the third example, as shown in FIG. 3C, the heater 30 comprises diametrically opposed electrical contacts 34 and a single heating element 36 connected to the electrical contacts 34 and extending between the electrical contacts 34 along a tortuous path. In the fourth example, as shown in FIG. 3D, the heater 30 comprises diametrically opposed electrical contacts 34 and a plurality of heating elements 36 connected to the electrical contacts 34 and extending between the electrical contacts 34 along substantially parallel paths. In the fifth example, as shown in FIG. 3E, the heater 30 is substantially the same as the first example heater as depicted in FIG. 3A, except that the cross-sectional area of the heating element 36 varies across the porous outer surface 32 to vary the heating profile of the heater 30 across the porous outer surface 32. In particular, the width of the heating element 36 is narrower towards the periphery of the outer surface 32 and increases towards the centre of the porous outer surface 32. This results in a reduction in the amount of heat generated by the heating element towards the centre of the porous outer surface 32 and an increase in the amount of heat generated by the heating element towards the periphery of the porous outer surface 32 relative to the arrangement shown in FIG. 3A. This allows the electric heater to compensate for heat loss from the periphery of the outer surface, for example heat loss due to thermal conduction, and reduces the temperature at the centre of the porous outer surface, resulting in more uniform temperature across the porous outer surface, as discussed below in relation to FIG. 4.

Figure 4:
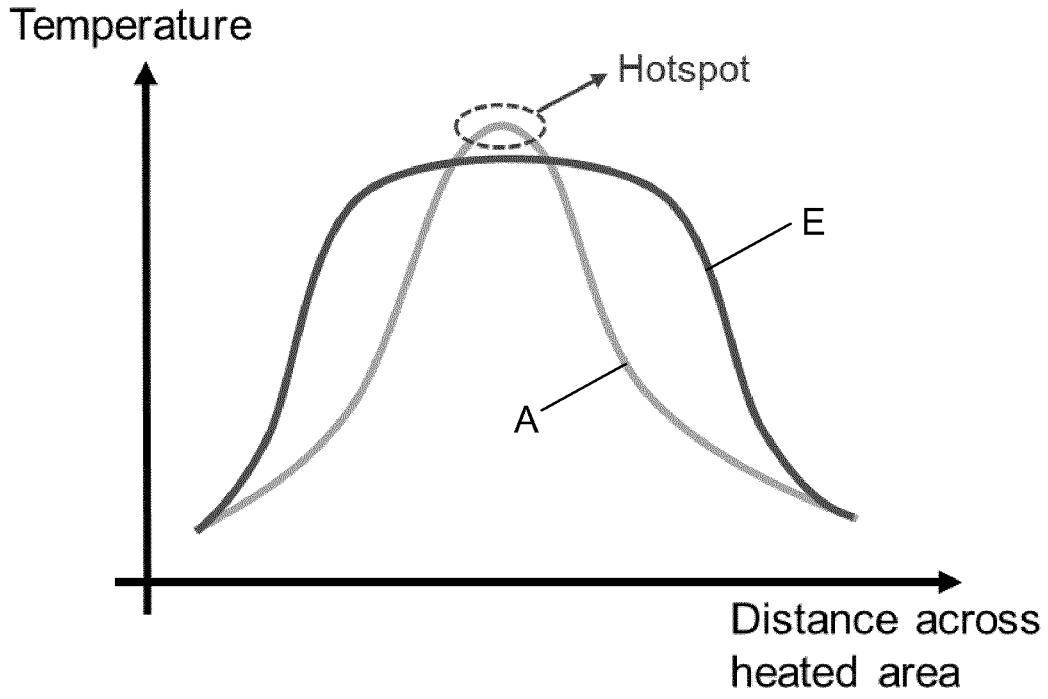
FIG. 4 shows a graph of temperature against distance across the outer surface of the capillary body for each of the arrangements of FIGS. 3A and 3E.

FIG. 4 is a graph of temperature against distance across the outer surface of the capillary body for each of the arrangements of FIGS. 3A and 3E. Curve A illustrates the temperature for the first example heater of FIG. 3A. Curve E illustrates the temperature for the fifth example heater of FIG. 3E. As illustrated by curve A, the temperature of the porous outer surface using the first example heater is lower towards its periphery and increases towards its centre to form a hot spot in a narrow region at the centre of the heating element. As illustrated by curve E, the temperature of the porous outer surface using the fifth example heater is higher towards its periphery than that of the porous outer surface using the first example heater. Additionally, the temperature at the centre of the porous outer surface is lower using the fifth example of heating element, and extends across a wider region, as illustrated by curve E. Thus, the temperature profile across the porous outer surface is more uniform for the fifth example heater than for the first example heater, particularly in the central region.

When the cartridge is assembled, the heating element 36 is in direct contact with the capillary material 22 and so aerosol-forming substrate can be conveyed directly to the heater. In examples of the invention, the aerosol-forming substrate contacts most, if not all, of the surface of the heating element 36 so that most of the heat generated by the heater assembly passes directly into the aerosol-forming substrate. In contrast, in conventional wick and coil heater assemblies only a small fraction of the heater wire is in contact with the aerosol-forming substrate.

In use the heater assembly preferably operates by resistive heating, although it may also operate using other suitable heating processes, such as inductive heating. Where the heater assembly operates by resistive heating, current is passed through the heater under the control of control electronics 16, to heat the filaments to within a desired temperature range. The heating element or elements 36 have a significantly higher electrical resistance than the electrical contacts 34 so that the high temperatures are localised to the heating element. The system may be configured to generate heat by providing electrical current to the heater in response to a user puff or may be configured to generate heat continuously while the device is in an "on" state. Different materials for the elements may be suitable for different systems. For example, in a continuously heated system, materials with a relatively low specific heat capacity are suitable and are compatible with low current heating. In a puff actuated system, in which heat is generated in short bursts using high current pulses, materials having a high specific heat capacity may be more suitable.

In a puff actuated system, the device may include a puff sensor configured to detect when a user is drawing air through the mouthpiece portion. The puff sensor (not illustrated) is connected to the control electronics 16 and the control electronics 16 are configured to supply current to the heater 30 only when it is determined that the user is puffing on the device. Any suitable air flow sensor may be used as a puff sensor, such as a microphone.

In a possible embodiment, changes in the resistivity of the at least one heating element may be used to detect a change temperature. This can be used to regulate the power supplied to the heater to ensure that it remains within a desired temperature range. Sudden changes in temperature may also be used as a means to detect changes in air flow past the heating element resulting from a user puffing on the system. One or more of the elements may be dedicated temperature sensors and may be formed from a material having a suitable temperature coefficient of resistance for that purpose, such as an iron aluminium alloy, Ni—Cr, platinum, tungsten or alloy.

The air flow through the mouthpiece portion when the system is used is illustrated in FIG. 1D. The mouthpiece portion includes internal baffles 17, which are integrally moulded with the external walls of the mouthpiece portion and ensure that, as air is drawn from the inlets 13 to the outlet 15, it flows over the heater 30 on the cartridge where aerosol-forming substrate is being vapourised. As the air passes the heater assembly, vapourised substrate is entrained in the airflow and cools to form an aerosol before exiting the outlet 15.

Although the embodiments described have cartridges with housings having a substantially circular cross section, it is of course possible to form cartridge housings with other shapes, such as rectangular cross section or triangular cross section. These housing shapes would ensure a desired orientation within the corresponding shaped cavity, to ensure the electrical connection between the device and the cartridge.

Other cartridge designs incorporating a heater assembly in accordance with this disclosure can now be conceived by one of ordinary skill in the art. For example, the cartridge may include a mouthpiece portion and may have any desired shape. Furthermore, a heater in accordance with the disclosure may be used in systems of other types to those already described, such as humidifiers, air fresheners, and other aerosol-generating systems.

Example 1

EpoTek (RTM) H20E, a silver-loaded epoxy electrically conductive glue available from Epoxy Technology Inc. of Billerica Mont. USA, was manually dispensed by needle tip onto a capillary body formed from Sterlitech GB140, a glass fibre capillary material available from Sterlitech Corporation of Kent Wash. USA, to form the heating element and the electrical contacts of the heater. To test the heater, an Agilent N6705B programmable power supply was used to pass an electrical current through the heater for 3 seconds. The current was supplied at a voltage of 3.55 V and with a power of 4.3 W. An infrared camera was used to record the temperature of the outer surface of the capillary body during the test.

Example 2

EpoTek (RTM) H20E, a silver-loaded epoxy electrically conductive glue available from Epoxy Technology Inc. of Billerica Mont. USA, was manually dispensed by needle tip onto a capillary body formed from a porous ceramic capillary material with a 20 micron pore size and 40-45 percent porosity, to form the heating element and the electrical contacts of the heater. To test the heater, an Agilent N6705B programmable power supply was used to pass an electrical current through the heater for 3 seconds. The current was supplied at a voltage of 3.55 V and with a power of 4.3 W. The heater resistance was measured at 2.3 Ohms. An infrared camera was used to record the temperature of the outer surface of the capillary body during the test, which was found to peak at 185 degrees Celsius.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. A heater assembly for an aerosol-generating system having a liquid storage portion configured to hold a liquid aerosol-forming substrate, the heater assembly comprising:
- an electric heater having at least one heating element configured to heat the liquid aerosol-forming substrate to form an aerosol; and
- an elongate capillary body configured to convey the liquid aerosol-forming substrate from the liquid storage portion of the aerosol-generating system to the at least one heating element,
- wherein the at least one heating element is formed from an electrically conductive material deposited directly onto a porous end surface of the elongate capillary body, and
- wherein a resistance of the at least one heating element decreases towards a center of the porous end surface to vary the heating profile of the electric heater across the porous end surface.

2. The heater assembly according to claim 1, wherein the electrically conductive material of the at least one heating element is at least partially diffused into the porous end surface of the elongate capillary body.

3. The heater assembly according to claim 1, wherein the at least one heating element comprises a printable electrically conductive material printed on the porous end surface of the elongate capillary body.

4. The heater assembly according to claim 1, wherein the electrically conductive material comprises one or more of a metal, an electrically conductive polymer, and an electrically conductive ceramic.

5. The heater assembly according to claim 1, wherein a cross-sectional area of the at least one heating element increases towards a center of the porous end surface to vary the heating profile of the electric heater.

6. The heater assembly according to claim 1,
- wherein spacing between adjacent parts of the at least one heating element defines a plurality of apertures in the electric heater, and
- wherein a size of the apertures varies to vary the heating profile of the electric heater.

7. The heater assembly according to claim 1, wherein the electric heater comprises at least one heating element formed from a first electrically conductive material and at least one heating element formed from a second electrically conductive material different than the first electrically conductive material, the first and the second electrically conductive materials being deposited directly onto the porous end surface of the elongate capillary body.

8. The heater assembly according to claim 1, wherein the electric heater comprises first and second electrically conductive contact portions in electrical contact with the at least one heating element, the first and the second electrically conductive contact portions being formed from an electrically conductive material deposited directly onto the porous end surface of the elongate capillary body.

9. The heater assembly according to claim 1,
- wherein the elongate capillary body includes a first capillary material and a second capillary material,
- wherein the at least one heating element is formed from an electrically conductive material deposited directly onto a porous end surface of the first capillary material, and
- wherein the second capillary material is in contact with the first capillary material and spaced apart from the heater assembly by the first capillary material, the first capillary material having a higher thermal decomposition temperature than that of the second capillary material.

10. A cartridge for an aerosol-generating system, the cartridge comprising:
- a liquid storage portion configured to hold a liquid aerosol-forming substrate; and
- a heater assembly, comprising:
  - an electric heater having at least one heating element configured to heat the liquid aerosol-forming substrate to form an aerosol; and
  - an elongate capillary body configured to convey the liquid aerosol-forming substrate from the liquid storage portion of the aerosol-generating system to the at least one heating element,
  - wherein the at least one heating element is formed from an electrically conductive material deposited directly onto a porous end surface of the elongate capillary body, and
  - wherein a resistance of the at least one heating element decreases towards a center of the porous end surface to vary the heating profile of the electric heater across the porous end surface.

11. The cartridge according to claim 10,
- wherein the elongate capillary body comprises a first end extending into the liquid storage portion and being configured to contact liquid therein, and a porous second end opposite to the first end, and wherein the at least one heating element is formed from an electrically conductive material deposited directly onto the second end of the elongate capillary body.

12. An aerosol-generating system, comprising:

an aerosol-generating device; and a cartridge comprising:

a liquid storage portion configured to hold a liquid aerosol-forming substrate; and a heater assembly, comprising:

an electric heater having at least one heating element configured to heat the liquid aerosol-forming substrate to form an aerosol; and an elongate capillary body configured to convey the liquid aerosol-forming substrate from the liquid storage portion of the aerosol-generating system to the at least one heating element, wherein the at least one heating element is formed from an electrically conductive material deposited directly onto a porous end surface of the elongate capillary body, wherein a resistance of the at least one heating element decreases towards a center of the porous end surface to vary the heating profile of the electric heater across the porous end surface, wherein the cartridge is removably coupled to the aerosol-generating device, and wherein the aerosol-generating device includes a power supply for the heater assembly.

13. The aerosol-generating system according to claim 12, wherein the aerosol-generating system is an electrically operated smoking system.

14. A method of manufacturing a cartridge for an aerosol-generating system, the method comprising:

providing a liquid storage portion for holding a liquid aerosol-forming substrate;

providing an elongate capillary body having a porous end surface;

forming an electric heating element by depositing an electrically conductive material directly onto the porous end surface of the elongate capillary body, wherein a resistance of the at least one heating element decreases towards a center of the porous end surface to vary the heating profile of the electric heater across the porous end surface;

filling the liquid storage portion with liquid aerosol-forming substrate; and connecting the elongate capillary body to the liquid storage portion such that liquid aerosol-forming substrate contained in the liquid storage portion is conveyed from the liquid storage portion to the electric heating element by the elongate capillary body.

15. The method according to claim 14, wherein the electrically conductive material is deposited by printing a printable electrically conductive material directly onto the porous end surface of the elongate capillary body.

16. The method according to claim 15, wherein the printable electrically conductive material comprises one or more additives selected from a group consisting of: solvents, curing agents, adhesion promoters, surfactants, viscosity reduction agents, and aggregation inhibitors.

* * * * *